US008529705B2

(12) United States Patent
Rolek

(10) Patent No.: US 8,529,705 B2
(45) Date of Patent: Sep. 10, 2013

(54) METHOD AND APPARATUS OF CONTROLLING THE RELEASE OF CLEANING AGENTS INTO A DISHWASHER CYCLE

(75) Inventor: Robert J. Rolek, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 403 days.

(21) Appl. No.: 12/640,582

(22) Filed: Dec. 17, 2009

(65) Prior Publication Data

US 2011/0146715 A1 Jun. 23, 2011

(51) Int. Cl.

| | |
|---|---|
| ***B08B 7/04*** | (2006.01) |
| ***B08B 3/00*** | (2006.01) |
| ***B08B 9/20*** | (2006.01) |

(52) U.S. Cl.

USPC ..... 134/25.2; 134/18; 134/56 D; 134/57 D; 134/58 D

(58) Field of Classification Search

USPC ..... 134/18, 25.2, 56 D, 57 D, 58 D

See application file for complete search history.

(56) References Cited

U.S. PATENT DOCUMENTS

| | | | | |
|---|---|---|---|---|
| 5,783,540 | A * | 7/1998 | Secemski et al. | 510/224 |
| 6,956,016 | B2 | 10/2005 | Speed et al. | |
| 2002/0117511 | A1* | 8/2002 | McNabb et al. | 221/197 |
| 2004/0045586 | A1* | 3/2004 | Rappette | 134/10 |
| 2007/0044820 | A1* | 3/2007 | Chan et al. | 134/18 |
| 2007/0246073 | A1* | 10/2007 | Kang | 134/18 |
| 2008/0060688 | A1* | 3/2008 | Buser | 134/56 D |
| 2010/0300487 | A1* | 12/2010 | Rolek et al. | 134/10 |
| 2010/0315351 | A1* | 12/2010 | Akbas | 345/173 |
| 2011/0087367 | A1* | 4/2011 | Gadini et al. | 700/231 |
| 2011/0247663 | A1* | 10/2011 | Gadini et al. | 134/115 R |

FOREIGN PATENT DOCUMENTS

| | | | |
|---|---|---|---|
| DE | 10039408 | | 12/2001 |
| DE | 102005011137 | A1 | 9/2006 |
| EP | 2009166 | | 12/2008 |
| WO | 2006094561 | A1 | 9/2006 |
| WO | 2007023475 | A1 | 3/2007 |
| WO | 2008080799 | A1 | 7/2008 |
| WO | WO 2009022101 | A1 * | 2/2009 |
| WO | WO 2009022223 | A2 * | 2/2009 |

* cited by examiner

*Primary Examiner* — Alexander Markoff

(74) *Attorney, Agent, or Firm* — Jacquelyn R. Lin; Diederiks & Whitelaw PLC

(57) ABSTRACT

A dishwashing machine includes a dispenser configured to receive a dishwashing tablet having a cleaning agent and a sensor operable to identify the dishwashing tablet in the dispenser. An electronic controller selects a dishwasher cycle based on the identity of the dishwashing tablet.

18 Claims, 3 Drawing Sheets

METHOD AND APPARATUS OF CONTROLLING THE RELEASE OF CLEANING AGENTS INTO A DISHWASHER CYCLE

TECHNICAL FIELD

The present disclosure relates generally to a dishwashing machine and more particularly to a mechanism and method of releasing cleaning agents into a dishwashing machine.

BACKGROUND

A dishwashing machine is a domestic appliance into which dishes and other cooking and eating wares (e.g., plates, bowls, glasses, flatware, pots, pans, bowls, and etceteras) are placed to be washed. During a dishwasher cycle, different cleaning agents are released to mix with fluid to form a wash chemistry to remove soil and food residues from the wares or a rinse chemistry to sanitize and/or dry the wares. Those cleaning agents may be primary or secondary cleaning agents that include, for example, a detergent, bleach, and/or chlorine. Additionally, the cleaning agents may be finishing cleaning agents such as rinse aid.

Multiple cleaning agents may be included in a single dishwashing product, which commonly takes the form of a tablet. U.S. Pat. No. 6,956,016 discloses an example of one such tablet and is incorporated expressly herein by reference. In one embodiment of U.S. Pat. No. 6,956,016, a single tablet has at least three different zones or pouches carrying at least three different cleaning agents (e.g., a primary cleaning agent, a secondary cleaning agent, and a finishing cleaning agent) to be introduced into the dishwasher cycle. Each pouch has a trigger mechanism for releasing separately each of the cleaning agents. The trigger mechanism is based on temperature but may also be based on pH, conductivity, pCa, pKa, redox potential, ionic concentration, enzymatic reaction, or time.

SUMMARY

According to one aspect, a dishwashing machine is disclosed. The dishwashing machine includes a tub defining a washing chamber, the tub having a sump formed in a bottom wall of the tub, a number of dish racks positioned in the washing chamber, and a pump operable to circulate fluid from the sump onto the number of dish racks. The dishwashing machine also includes a dispenser in fluid communication with the washing chamber. The dispenser is configured to receive a dishwashing tablet having a cleaning agent. The dishwashing machine also includes a sensor configured to identify the dishwashing tablet in the dispenser and generate an electrical output signal indicative of the identity of the dishwashing tablet. The dishwashing machine includes an electronic controller configured to receive the electrical output signal from the sensor, select a dishwasher cycle associated with the identity of the dishwashing tablet, and generate a control signal to operate the pump in accordance with the selected dishwasher cycle.

In some embodiments, the sensor may be configured to identify each of a plurality of cleaning agents of the dishwashing tablet, and the electronic controller may be configured to select the dishwasher cycle having a plurality of stages associated with the plurality of cleaning agents. In some embodiments, the dispenser may be configured to release the cleaning agent from the dishwashing tablet.

Additionally, in some embodiments, the dishwashing machine may include a second pump coupled to the dispenser, and the second pump may be operable to circulate fluid from the sump to the dispenser. The dishwashing machine may include an electric heater operable to heat fluid within the dispenser such that fluid temperature in the dispenser may be controlled separately from fluid temperature in the sump. In some embodiments, the dispenser may be operable to move fluid mixed with the released cleaning agent into the sump. In some embodiments, the sensor may be configured to read an RFID tag of the dishwashing tablet to identify the dishwashing tablet.

According to another aspect, a method of operating a dishwashing machine is disclosed. The method includes determining an identity of a dishwashing tablet positioned in a dispenser and generating an output signal indicative of the identity of the dishwashing tablet. The method also includes selecting a dishwasher cycle from an electronic memory device based on the identity of the dishwashing tablet in response to generation of the output signal and generating a control signal to operate a dishwashing machine in accordance with the selected dishwasher cycle so as to release a chemical agent from the dishwashing tablet into the dishwasher cycle at a predetermined release time.

In some embodiments, determining the identity of the dishwashing tablet may include reading an RFID tag of the dishwashing tablet to identify the dishwashing tablet. In some embodiments, selecting the dishwasher cycle may include selecting the dishwasher cycle from a plurality of dishwasher cycles stored in a look-up table. Additionally, in some embodiments, determining the identity of the dishwashing tablet may include sensing the identity of any of a plurality of cleaning agents sealed in the dishwashing tablet.

In some embodiments, selecting the dishwasher cycle may include determining a plurality of stages associated with the plurality of cleaning agents. In some embodiments, generating the control signal may include generating a first control signal to operate the dishwashing machine to supply a quantity of fluid to the dispenser and generating a second control signal to operate the dishwashing machine to heat the quantity of fluid in the dispenser so as to release the cleaning agent at a predetermined release time.

Additionally, in some embodiments, selecting the dishwasher cycle may include creating a customized dishwasher cycle based on the identity of the dishwashing tablet. In some embodiments, creating the customized dishwasher cycle may include selecting a plurality of stages and selecting a duration of each of the plurality of selected stages. In some embodiments, creating the customized dishwasher cycle may include selecting a predetermined release time for each of a plurality of cleaning agents.

According to another aspect, the method includes determining an identity of a dishwashing tablet in a dispenser and generating an output signal indicative of the identity of the dishwashing tablet, selecting a dishwasher cycle associated with the identity of the dishwashing tablet in response to generation of the output signal, generating a control signal to operate the dishwashing machine in accordance with the selected dishwasher cycle, supplying fluid to the dispenser so as to release a cleaning agent from the dishwashing tablet, and circulating fluid mixed with the cleaning agent from the dispenser to a washing chamber of the dishwashing machine at a predetermined release time.

In some embodiments, supplying fluid to the dispenser may include operating a pump to circulate a fluid from a sump to the dispenser, and heating fluid to a predetermined temperature so as to trigger the release of the cleaning agent from the dishwashing tablet into the dispenser. In some embodiments, determining the identity of the dishwashing tablet may include setting the predetermined release time for the cleaning agent.

In some embodiments, the method may also further include refining the selected dishwasher cycle based on sensor data recorded while fluid is being circulated throughout the dishwasher cycle.

BRIEF DESCRIPTION OF THE DRAWINGS

The detailed description particularly refers to the following figures, in which.

DETAILED DESCRIPTION OF THE DRAWINGS

Figure 1:
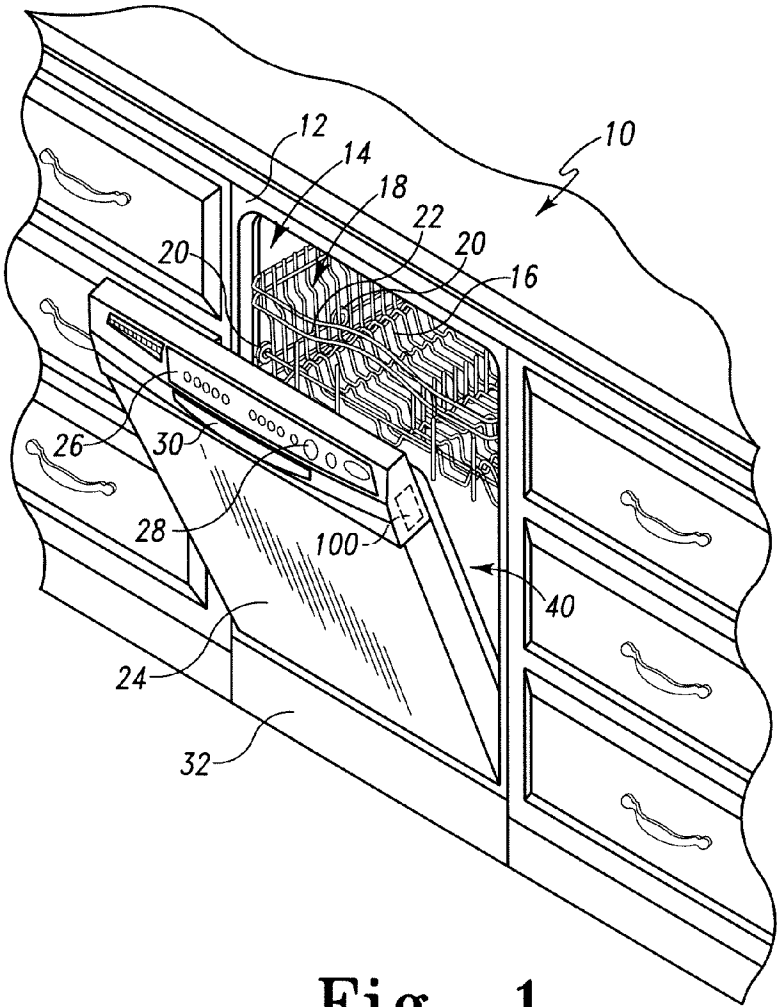
FIG. 1 is a perspective view of a dishwashing machine.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

The present disclosure relates to a method of operating a dishwashing machine in accordance with a selected dishwasher cycle or a selected stage of a dishwasher cycle. The dishwasher cycle and stages are selected based on the identity of the tablet to be used in the dishwasher cycle. By use of the term "dishwasher cycle," it is meant the operation of a dishwasher upon a set of soiled wares that produces a set of cleaned wares, starting with user activation, then proceeding continuously without the need for user intervention, and including at least one washing stage and at least one rinsing stage. A washing stage involves the application of a wash chemistry, typically water and detergent, to remove soils from the wares. A rinsing stage involves the application of a rinse chemistry, typically water and rinse aid, to remove the wash chemistry and prepare the wares for drying. A dishwasher cycle may optionally include other stages, such as a drying stage in which heat is applied after the rinsing stage. A dishwasher cycle may be interrupted by a user, such as by opening a door of the dishwasher, thereby causing the dishwasher cycle to pause until the door is closed. However, without such user intervention, the dishwasher cycle will proceed continuously.

At the completion of a dishwasher cycle, a user will remove the set of cleaned wares, either immediately or after a period of time. The period between the dishwasher cycles of the dishwasher thus begins when the user removes a set of cleaned wares from the dishwasher and ends when the user activates a subsequent dishwasher cycle.

Referring to FIG. 1, a dishwashing machine 10 (hereinafter dishwasher 10) is shown. The dishwasher 10 has a tub 12 that defines a washing chamber 14 into which a user may place dishes and other cooking and eating wares (e.g., plates, bowls, glasses, flatware, pots, pans, bowls, etc.) to be washed. The dishwasher 10 includes a number of racks 16 located in the tub 12. An upper dish rack 16 is shown in FIG. 1; although a lower dish rack is also included in the dishwasher 10. A number of roller assemblies 18 are positioned between the dish racks 16 and the tub 12. The roller assemblies 18 allow the dish racks 16 to extend from and retract into the tub 12, thereby facilitating the loading and unloading of the dish racks 16. The roller assemblies 18 include a number of rollers 20 that move along a corresponding support rail 22.

A door 24 is hinged to the lower front edge of the tub 12. The door 24 permits user access to the tub 12 to load and unload the dishwasher 10. The door 24 also seals the front of the dishwasher 10 during a dishwasher cycle. A control panel 26 is located at the top of the door 24. The control panel 26 includes a number of controls 28, such as buttons and knobs, which are used to control the operation of the dishwasher 10. A handle 30 is also included on the door 24. The user may use the handle 30 to unlatch the door 24 such that the door 24 may be opened.

A machine compartment 32 is located below the tub 12. The machine compartment 32 is sealed from the tub 12. In other words, unlike the tub 12, which is filled with fluid and exposed to spray during the dishwasher cycle, the machine compartment 32 does not fill with fluid and is not exposed to spray during the operation of the dishwasher 10. The machine compartment 32 houses components such as the dishwasher's water pump(s) and valve(s), along with the associated wiring and plumbing. It should be noted that, although FIG. 1 depicts a dishwasher 10 installed in a kitchen cabinet, portable dishwashers, which may be removably connected to a faucet, are also contemplated.

Figure 2:
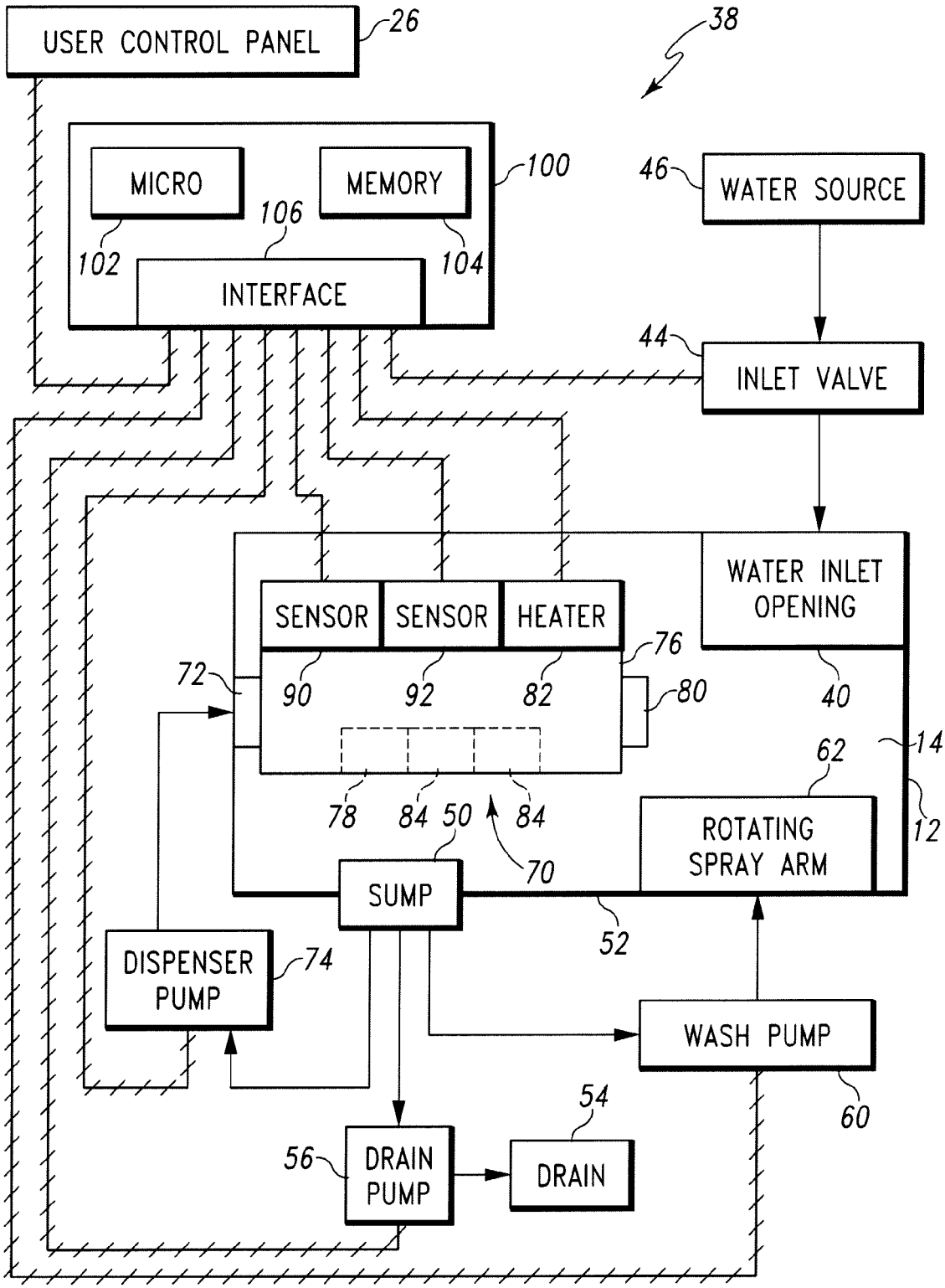
FIG. 2 is a simplified block diagram of one illustrative embodiment of a control system for the dishwashing machine of FIG. 1.

Referring now to FIG. 2, a control system 38 of the dishwasher 10, according to one illustrative embodiment, is shown in a simplified block diagram. A sidewall of the tub 12 includes a water inlet opening 40. The water inlet opening 40 directs water received from an external water source 46 (e.g., house water supply, kitchen faucet, etceteras) into the washing chamber 14. A water inlet valve 44 positioned between the external water source 46 and the water inlet opening 40 may be selectively opened or closed to control the flow of water through the water inlet opening 40. In some embodiments, the water inlet valve 44 may be an electromechanical valve, such as a solenoid-controlled valve, which opens and closes in response to a control signal.

The dishwasher 10 further includes a sump 50 which is formed (e.g., stamped) into a bottom wall 52 of the tub 12. In particular, the sump 50 defines a reservoir that extends downwardly in a direction away from the washing chamber 14. The bottom wall 52 of the tub 12 has a sloped configuration that directs the wash chemistry or the rinse chemistry into the sump 50. The sump 50 is connected to an external drain 54 (e.g., house sewer line, kitchen sink, etceteras). A drain pump 56 is positioned between the sump 50 and the external drain 54. A control signal may selectively energize the drain pump 56 to drain fluids from the sump 50 or de-energize (turn off) the drain pump 56 to retain fluids in the sump 50. In other embodiments, an electromechanical valve, such as a solenoid-controlled valve, that opens and closes in response to a control signal may be used in place of drain pump 56.

A wash pump 60 located in the machine compartment 32 is operable to circulate fluids in the sump 50 onto the dish racks 16 (not shown in FIG. 2). The wash pump 60 is connected to a rotating spray arm 62 that sprays water and/or wash chemistry onto the dish racks 16 (and hence any wares positioned thereon). Additional rotating spray arms (not shown) are positioned above the spray arm 62. It should also be appreciated that the dishwashing machine 10 may include other spray arms positioned at various locations in the tub 12. The spray arm 62 has a number of nozzles (not shown). A control signal may selectively energize the wash pump 60 to supply fluid from the sump 50 to the spray arm 62, which then exits the spray arm 62 through the nozzles.

A dispenser 70 is also included in the dishwasher 10. The dispenser 70 has an inlet valve 72 coupled to a dispenser pump 74. A reaction chamber 76 sized to receive a tablet 78 is positioned between the inlet valve 72 and an outlet valve 80. The inlet valve 72 and outlet valve 80 are each an electromechanical valve, such as a solenoid-controlled valve, which opens and closes in response to a control signal. When the inlet valve 72 is open, the dispenser pump 74 is operable to advance a quantity of fluid from the sump 50 into the reaction chamber 76 and into contact with the tablet 78. When the outlet valve 80 is open, fluid is advanced from the reaction chamber 76 into the washing chamber 14. It will be appreciated that the outlet valve 80 may be an actionable drain or other mechanism operable to open in response to a control signal such that fluid is advanced from the reaction chamber 76 into the washing chamber 14. It will be further appreciated that in some embodiments the quantity of fluid advanced into the dispenser 70 may be a metered amount advanced directly from the inlet valve 72. It will be further appreciated that in some embodiments fluid advanced into the dispenser 70 may be some amount advanced directly from the inlet valve(s) 72, which could be controlled to modulate temperatures.

When the valves 72, 80 of the dispenser 70 are closed during a dishwasher cycle, fluid is retained in the reaction chamber 76. An electric heater 82 is positioned adjacent to the dispenser 70 and is configured to heat the contents of the reaction chamber 76. In that way, the temperature of fluid in the reaction chamber 76 may be controlled separately from the temperature of fluids in the washing chamber 14. It will be appreciated that in other embodiments the electric heater 82 may be integrated into the dispenser 70.

The tablet 78 received in the reaction chamber 76 has a plurality of pouches 84. Each of the pouches 84 encloses one of a plurality of cleaning agents. A "cleaning agent" may be a primary cleaning agent that is used in, for example, a main wash stage. A cleaning agent may also be a secondary cleaning agent that is used in, for example, a pre-soak stage, a pre-wash stage, a secondary washing stage after the main washing stage, or a pre-final rinsing stage or a first rinsing stage that follows the main dishwasher cycle. In addition, a cleaning agent may also be a finishing cleaning agent, such as, for example, a glass shine or a restoration agent, a sanitizing agent, or a rinse aid that is used in an intermediate or final rinsing stage. It should be appreciated that the cleaning agent may be any liquid, gel, powder, or tablet form thereof capable of mixing with the circulating fluids to clean, sanitize, and/or dry the wares positioned in the washing chamber 14. It should also be appreciated that in other embodiments the tablet 78 may have only a single cleaning agent that may or may not be enclosed in a pouch 84.

In the illustrative embodiment, each pouch 84 has a film material that encloses one of the plurality of cleaning agents. The film material is soluble in fluid and is responsive to fluid temperature such that it dissolves only when the fluid reaches a predetermined temperature. In this way, the release of each of the different cleaning agents may be regulated and matched to specific stages of the dishwasher cycle.

For example, a first pouch of the tablet 78 may enclose a primary cleaning agent and a second pouch may enclose a finishing cleaning agent. The film of the first pouch may be configured to dissolve at one temperature while the film of the second pouch may be configured to dissolve at a different temperature. In such a case, using the electric heater 82 to adjust the temperature of the fluid in the reaction chamber 76 to one temperature releases only the primary cleaning agent from the first pouch such that the primary cleaning agent mixes with the fluid in the reaction chamber 76. The finishing cleaning agent, however, remains sealed in the second pouch. After the primary cleaning agent is released from the pouch, the outlet valve 80 may be opened so that the mixture of fluid and the primary cleaning agent advances from the reaction chamber 76 into the washing chamber 14. In the washing chamber 14, the primary cleaning agent passes into the sump 50 and mixes with the fluid retained therein to form a wash chemistry that may be circulated onto the wares positioned in washing chamber 14.

It will be appreciated that in other embodiments the pouches 84 may be responsive to other changes in the fluid. For example, the pouches 84 may be responsive to the pH level, redox potential, ionic concentration, or enzyme concentration of the fluid. In those embodiments, the dishwasher 10 would include the additional mechanisms or devices necessary to adjust those aspects of the fluid and thereby selectively release the one of the cleaning agents from its corresponding pouch 84. It will also be appreciated that a variety of selective coatings and/or binding agents may be used as an alternative to pouches to obtain a selective and sequential dissolution effect.

The dishwasher 10 also includes an identification sensor 90. The identification sensor 90 may be optionally positioned in or adjacent to the dispenser 70 to sense or otherwise determine the identity of the tablet 78 positioned in the reaction chamber 76. For example, the tablet 78 may be equipped with an RFID tag that transmits a signal indicative of the identity of the tablet 78. In such a case, the identification sensor 90 may be embodied as an RF reader that is operable to read the contents of such an RFID tag and transmit an output signal indicative of the identity of the tablet 78. The signal may include characteristics of the tablet 78 such as the number or type of different cleaning agents along with the parameters (e.g., specific temperature or pH) for releasing each cleaning agent. Such information may be encoded in the signal generated by the RFID tag and looked-up in response to the signal generated by the RFID tag. Alternatively, the identification sensor 90 may be operable to sense the identity of the different cleaning agents directly and transmit an output signal indicative of the identity of each of the different cleaning agents included in tablet 78.

In another embodiment, the identification sensor 90 may be a pH sensor configured to measure the pH of the fluid mixture in the reaction chamber 76 after one of the plurality of cleaning agents has been released from its corresponding pouch 84. It will be appreciated that in other embodiments the identification sensor 90 may take the form of an optical sensor or an electrochemical sensor configured to sense the tablet 78 and generate an output signal indicative of the identity of the tablet 78 and/or any cleaning agents included therein.

A temperature sensor 92 may be optionally positioned in or adjacent to the dispenser 70 to measure the temperature of the contents of the reaction chamber 76. The temperature sensor 92 is configured to take a temperature measurement of the fluid in the reaction chamber 76 and transmit a signal indicative of that measurement.

The dishwasher 10 also includes an electronic control unit (ECU) or "electronic controller" 100. The electronic controller 100 may be positioned in the door 24 or the machine compartment 32 of the dishwasher 10. The electronic controller 100 is, in essence, the master computer responsible for interpreting electrical signals sent by sensors associated with the dishwasher 10 and for activating or energizing electronically-controlled components associated with the dishwasher 10. For example, the electronic controller 100 is configured to control operation of the water inlet valve 44, the inlet valve 72, the outlet valve 80, the electric heater 82, the dispenser pump 74, the drain pump 56, and the wash pump 60. The electronic controller 100 also monitors various signals from the control panel 26, the identification sensor 90 and determines when various operations of the dishwasher 10 should be performed. As will be described in more detail below with reference to FIG. 3, the electronic controller 100 is operable to control the components of the dishwasher 10 such that the dishwasher 10 operates a dishwasher cycle based on information including the identity of the tablet 78.

To do so, the electronic controller 100 includes a number of electronic components commonly associated with electronic units utilized in the control of electromechanical systems. For example, the electronic controller 100 may include, amongst other components customarily included in such devices, a processor such as a microprocessor 102 and a memory device 104 such as a programmable read-only memory device ("PROM") including erasable PROM's (EPROM's or EEPROM's). The memory device 104 is provided to store, amongst other things, instructions in the form of, for example, a software routine (or routines) which, when executed by the microprocessor 102, allows the electronic controller 100 to control operation of the dishwasher 10.

The electronic controller 100 also includes an analog interface circuit 106. The analog interface circuit 106 converts the output signals from various sensors (e.g., the identification sensor 90) into signals which are suitable for presentation to an input of the microprocessor 102. In particular, the analog interface circuit 106, by use of an analog-to-digital (A/D) converter (not shown) or the like, converts the analog signals generated by the sensors into digital signals for use by the microprocessor 102. It should be appreciated that the A/D converter may be embodied as a discrete device or number of devices, or may be integrated into the microprocessor 102. It should also be appreciated that if any one or more of the sensors associated with the dishwasher 10 generate a digital output signal, the analog interface circuit 106 may be bypassed.

Similarly, the analog interface circuit 106 converts signals from the microprocessor 102 into output signals which are suitable for presentation to the electrically-controlled components associated with the dishwasher 10 (e.g., the wash pump 60). In particular, the analog interface circuit 106, by use of a digital-to-analog (D/A) converter (not shown) or the like, converts the digital signals generated by the microprocessor 102 into analog signals for use by the electronically-controlled components associated with the dishwasher 10. It should be appreciated that, similar to the A/D converter described above, the D/A converter may be embodied as a discrete device or number of devices, or may be integrated into the microprocessor 102. It should also be appreciated that if any one or more of the electronically-controlled components associated with the dishwasher 10 operate on a digital input signal, the analog interface circuit 106 may be bypassed.

Thus, the electronic controller 100 may control operation of the dishwasher 10 based on the identity of the tablet 78. In particular, the electronic controller 100 executes a routine including, amongst other things, a control scheme in which the electronic controller 100 monitors outputs of the sensors associated with the dishwasher 10 to control the inputs to the electronically-controlled components associated therewith. To do so, the electronic controller 100 communicates with the sensors associated with the dishwasher 10 to determine, amongst numerous other things, the state of the door 24, the identity of the tablet 78 (including the identity of the cleaning agents present in the tablet 78). Armed with this data, the electronic controller 100 performs numerous calculations, either continuously or intermittently, including looking up values in preprogrammed tables, in order to execute algorithms to perform such functions as controlling the drain pump 56 to retain fluid in the sump 50, determining when to release a cleaning agent from the dispenser 70, controlling the wash pump 60 to apply the mixture of fluid and the cleaning agent to soils on wares in the dishwasher 10, etceteras.

As will be appreciated by those of the skill in the art, the dishwasher 10 may include elements other than those shown and described above, such as, by way of example, an electric heating element to assist in drying the wares or a filter to remove particulates from the re-circulated wash chemistry or rinse chemistry. The dishwasher 10 may also include a variety of other sensors that monitor conditions within the washing chamber 14, the sump 50, and/or other components of the dishwasher 10. It should also be appreciated that the location of many components (i.e., in the washing chamber 14, in the machine compartment 32, in or on the door 24) may also be altered.

Figure 3:
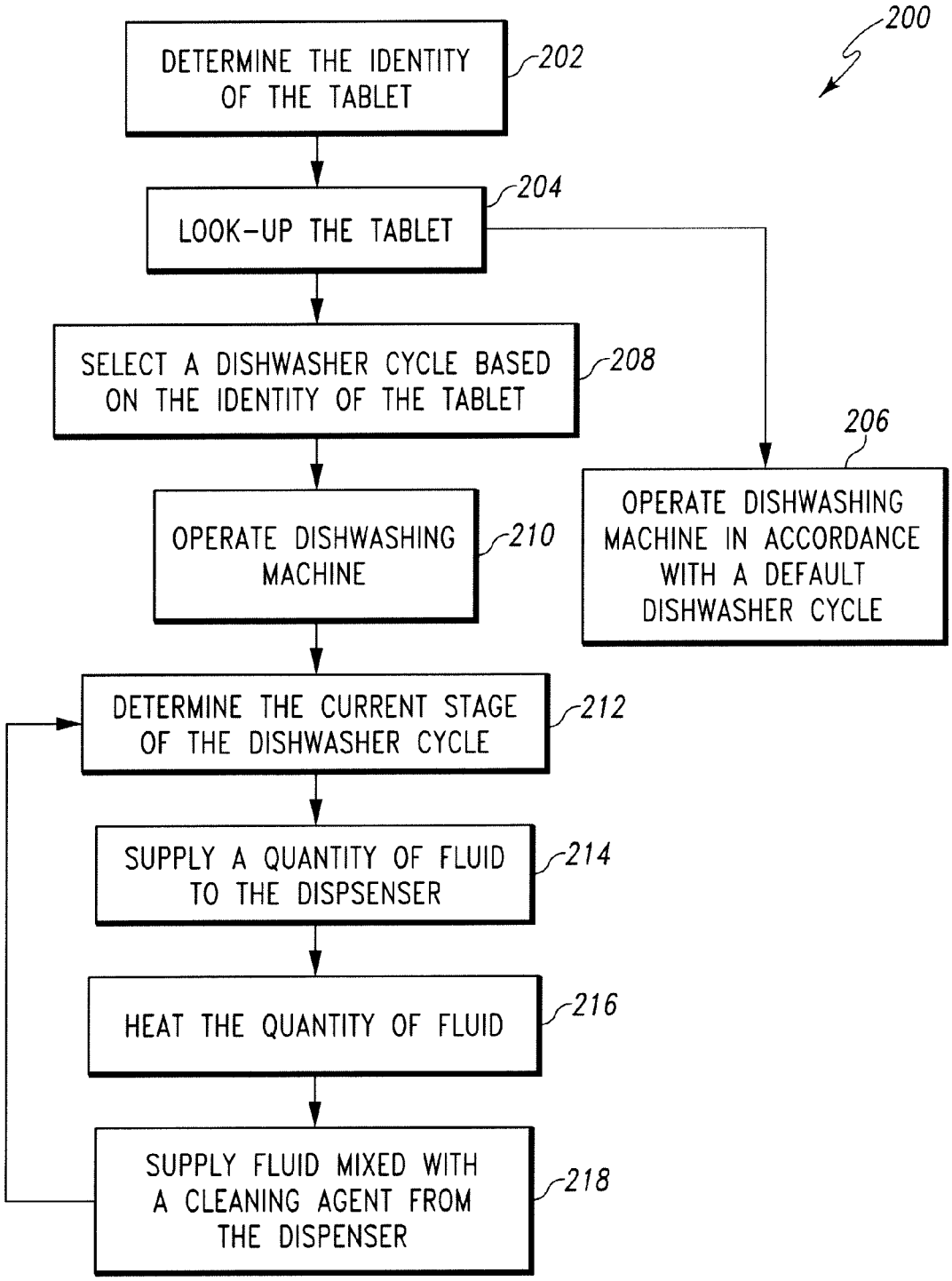
FIG. 3 is a simplified flow chart of a method of operating the dishwashing machine of FIG. 2.

Referring now to FIG. 3, an illustrative embodiment of a control routine 200 for operating the dishwasher of FIG. 2 is illustrated as a simplified flow diagram. The routine 200 begins with step 202 in which the electronic controller 100 determines the identity of the tablet 78. To do this, the identification sensor 90 reads an RFID tag of the tablet 78 and generates an output signal indicative of the identity of the tablet 78. The identification sensor 90 may also be an optical sensor or any other sensor configured to scan the tablet 78 and generate an output signal indicative of its identity.

In step 204, the electronic controller 100 uses the output signal to identify the tablet 78 by selecting from a look-up table stored in the memory device 104. The look-up table includes information relating to numerous tablets 78, including the identity of the cleaning agents sealed in each tablet 78. Additionally, the look-up table includes a sequence or order in which each of the plurality of cleaning agents is released from a particular tablet 78. The look-up table may also include the predetermined temperature at which each of the plurality of cleaning agents is released.

There are circumstances where the electronic controller 100 may not be able to identify the tablet 78. For example, the user may choose a tablet 78 that does not include an RFID tag or other means of identification. In such a case, the electronic controller 100 selects a default base dishwasher cycle and proceeds to step 206. In step 206, the dishwasher 10 runs the default dishwasher cycle and the tablet 78 is released in a conventional fashion during the default dishwasher cycle.

If the tablet 78 is identified in step 204, the electronic controller 100 proceeds to step 208 in which the electronic controller 100 selects a base dishwasher cycle based on the identity of the tablet 78. The dishwasher cycle is selected from a plurality of dishwasher cycles stored in a look-up table in the memory device 104. For example, if the tablet 78 includes a finishing cleaning agent with a sanitizer, the electronic controller 100 may select a dishwasher cycle that includes a reduced temperature drying stage. In this way, the dishwasher cycle is selected based on the identity of the tablet 78. The electronic controller 100 also selects a predetermined release time for releasing each of the cleaning agents into the washing chamber 14.

In another embodiment, the electronic controller 100 may build a customized dishwasher cycle based on the identity of each of the cleaning agents included in the tablet 78. In that case, the electronic controller 100 selects from a look-up table a stage associated with each of the plurality of cleaning agents. The electronic controller 100 assemblies each of the selected wash stages into a customized dishwasher cycle based on the release sequence of the cleaning agents determined in step 204. Additionally, the electronic controller 100 sets the initial planned duration of each of the selected stages based on its associated cleaning agent. The concentration, quantity, and type of cleaning agent influences the amount of time the cleaning agent requires to properly clean or sanitize the wares positioned in the washing chamber 14. Accordingly, the electronic controller 100 adjusts the duration of each of the selected stages depending on the identity of each of the cleaning agents. The electronic controller 100 then sets a predetermined release time for releasing each of the cleaning agents into the washing chamber 14. In some embodiments, the controller 100 may also adjust the duration and release time based on initial sensor measurements, such as, for example, the dishwasher load, soil type, or soil level. It will be appreciated that sensor measurements recorded during the various stages may be used to further refine and optimize the dishwasher cycle.

In step 210, the electronic controller 100 generates a control signal to operate the dishwasher 10 in accordance with the selected dishwasher cycle. As discussed above, a typical dishwasher cycle may include at least one wash stage and at least one rinse stage but may include additional stages. The electronic controller 100 generates a series of control signals to energize or de-energize the water inlet valve 44 and the drain pump 56 to fill or drain the sump 50 over the course of the various stages of the dishwasher cycle. Similarly, the electronic controller 100 generates a control signal to activate the wash pump 60 to supply fluid from the sump 50 to the spray arm 62 and onto the wares positioned in washing chamber 14.

In step 212, the electronic controller 100 monitors the operation of the dishwasher 10 to determine the current stage of the dishwasher cycle. If one of the cleaning agents is to be released during the current stage, the electronic controller 100 generates in step 214 a control signal to activate the dispenser pump 74. The dispenser pump 74 supplies fluid from the sump 50 to the dispenser 70. Fluid is retained in the reaction chamber 76 by the closing the inlet valve 72 and outlet valve 80.

In step 216, the electronic controller 100 generates a control signal to activate the electric heater 82. As described above, the electric heater 82 is configured to supply heat to the dispenser 70 to raise the temperature of the fluid within the reaction chamber 76. The electric heater 82 heats the fluid to the predetermined temperature required to dissolve the pouch 84 and release the cleaning agent into the reaction chamber 76. A mixture of the released cleaning agent and fluid is thereby created in the reaction chamber 76.

In step 218, the electronic controller 100 generates a control signal at the predetermined release time to open outlet valve 80. The mixture of the cleaning agent and fluid are moved from the reaction chamber 76 into the washing chamber 14. Any remaining pouches 84 of the tablet 78 remain in the reaction chamber 76 for release later in the dishwasher cycle. In the sump 50, the released cleaning agent further mixes with the fluids retained therein to form a wash or rinse chemistry that may be sprayed onto the wares positioned in the washing chamber 14.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A dishwashing machine, comprising:

a tub defining a washing chamber, the tub having a sump formed in a bottom wall of the tub, a number of dish racks positioned in the washing chamber, a pump operable to circulate fluid from the sump onto the number of dish racks, a dispenser in fluid communication with the washing chamber, the dispenser being configured to receive a dishwashing tablet having a cleaning agent, an electric heater operable to heat fluid within the dispenser such that fluid temperature in the dispenser may be controlled separately from fluid temperature in the sump, a sensor configured to identify the dishwashing tablet in the dispenser and generate an electrical output signal indicative of the identity of the dishwashing tablet, and an electronic controller configured to (i) receive the electrical output signal from the sensor, (ii) select a dishwasher cycle associated with the identity of the dishwashing tablet, and (iii) generate a control signal to operate the dishwashing machine in accordance with the selected dishwasher cycle.

2. The dishwashing machine of claim 1, wherein:

the sensor is configured to identify each of the at least two different types of cleaning agents in the dishwashing tablet, and the electronic controller is configured to select the dishwasher cycle having a plurality of stages associated with the at least two different types of cleaning agents.

3. The dishwashing machine of claim 2, wherein the identity of the dishwashing tablet is constituted by characteristics of each of the at least two different types of cleaning agents in the dishwashing tablet.

4. The dishwashing machine of claim 1, further comprising: a second pump coupled to the dispenser, the second pump being operable to circulate fluid from the sump to the dispenser, wherein the dispenser is operable to move fluid mixed with the released cleaning agent into the sump.

5. The dishwashing machine of claim 1, wherein the sensor is configured to read an RFID tag of the dishwashing tablet to identify the dishwashing tablet.

6. A method of operating a dishwashing machine, comprising:

determining an identity of a dishwashing tablet positioned in a dispenser and generating an output signal indicative of the identity of the dishwashing tablet by identifying at least two different types of cleaning agents in the dishwashing tablet, selecting a dishwasher cycle stored in an electronic memory device based on the identity of the dishwashing tablet in response to generation of the output signal, and generating a control signal to operate the dishwashing machine in accordance with the selected dishwasher cycle so as to release a chemical agent from the dishwashing tablet into the dishwasher cycle at a predetermined release time, wherein generating the control signal to operate the dishwashing machine comprises: generating a first control signal to operate the dishwashing machine to supply a quantity of fluid to the dispenser having the dishwashing tablet positioned therein, and generating a second control signal to operate the dishwashing machine to heat the quantity of fluid in the dispenser so as to release the chemical agent at a predetermined release time.

7. The method of claim 6, wherein determining the identity of the dishwashing tablet includes reading an RFID tag of the dishwashing tablet to identify the dishwashing tablet.

8. The method of claim 6, wherein selecting the dishwasher cycle includes selecting the dishwasher cycle from a plurality of dishwasher cycles stored in a look-up table.

9. The method of claim 6, wherein determining the identity of the dishwashing tablet includes sensing the identity of each of the at least two different types of cleaning agents which are sealed in the dishwashing tablet.

10. The method of claim 9, wherein selecting the dishwasher cycle includes determining a plurality of stages associated with the at least two different types of cleaning agents.

11. The method of claim 6, wherein selecting the dishwasher cycle includes creating a customized dishwasher cycle based on the identity of the dishwashing tablet.

12. The method of claim 11, wherein creating the customized dishwasher cycle includes selecting a plurality of stages and selecting a duration of each of the plurality of selected stages.

13. The method of claim 11, wherein creating the customized dishwasher cycle includes selecting a predetermined release time for each of the at least two different types of cleaning agents.

14. A method of operating a dishwashing machine, comprising:

determining an identity of a dishwashing tablet in a dispenser, including sensing the identity of at least two different types of cleaning agents sealed in the dishwashing tablet, and generating an output signal indicative of the identity of the dishwashing tablet, selecting a dishwasher cycle based on the identity of the dishwashing tablet in response to generation of the output signal, generating a control signal to operate a dishwashing machine in accordance with the selected dishwasher cycle, supplying fluid and heat from a heater to the dispenser so as to release a cleaning agent from the dishwashing tablet, and circulating fluid mixed with the cleaning agent from the dispenser to a washing chamber of the dishwashing machine at a predetermined release time.

15. The method of claim 14, wherein selecting the dishwasher cycle includes selecting the dishwasher cycle from a plurality of dishwasher cycles stored in a look-up table.

16. The method of claim 14, wherein supplying fluid and heat to the dispenser includes:

operating a pump to circulate a quantity of fluid from a sump to the dispenser, and heating fluid to a predetermined temperature so as to trigger the release of the cleaning agent from the dishwashing tablet into the dispenser.

17. The method of claim 14, wherein determining the identity of the dishwashing tablet includes setting the predetermined release time for the cleaning agent.

18. The method of claim 14, further comprising:

sensing cleaning agent data during the selected dishwasher cycle; and refining the selected dishwasher cycle based on the cleaning agent data while fluid is being circulated in the dishwashing machine.

* * * * *